United States Patent [19]

Allen et al.

[11] 4,010,889

[45] Mar. 8, 1977

[54] ENVELOPE ASSEMBLY

[75] Inventors: Robert H. Allen, North Tonawanda; Edmund G. Van Malderghem, Lewiston; Victor J. Robertson, Niagara Falls; William C. Shook, Wilson, all of N.Y.

[73] Assignee: Moore Business Forms, Inc., Niagara Falls, N.Y.

[22] Filed: Oct. 9, 1975

[21] Appl. No.: 621,165

[52] U.S. Cl. ..... 229/69; 229/85

[51] Int. Cl.[2] ..... B65D 27/10

[58] Field of Search ..... 229/69, 85; 282/11.5 R, 282/11.5 A, 25

[56] References Cited

UNITED STATES PATENTS

| | | | |
|---|---|---|---|
| 3,088,754 | 5/1963 | Burgmer | 282/11.5 A |
| 3,325,188 | 6/1967 | Hiersteiner | 229/69 X |
| 3,339,827 | 9/1967 | Steidinger | 229/69 |
| 3,777,971 | 12/1973 | Steidinger | 229/69 X |
| 3,905,545 | 9/1975 | Juszak et al. | 229/69 |

FOREIGN PATENTS OR APPLICATIONS

| | | | |
|---|---|---|---|
| 790,434 | 7/1968 | Canada | 229/69 |

*Primary Examiner*—Stephen P. Garbe
*Attorney, Agent, or Firm*—Watson, Cole, Grindle & Watson

[57] ABSTRACT

A sealed envelope is pre-stuffed with at least one insert sheet which is positively held in place against any shifting movements relative to the envelope by retention elements attached only to the envelope and in abutting engagement with marginal edges of the insert sheets.

11 Claims, 8 Drawing Figures

ENVELOPE ASSEMBLY

BACKGROUND OF THE INVENTION

This invention relates generally to a stuffed sealed envelope assembly, and more particularly to such an assembly having insert material therein immobilized against shifting movements by retention elements attached to the envelope and in abutting relationship to marginal edges of the insert sheet.

In U.S. Pat. No. 3,339,827, an assembly of stuffed sealed envelopes is disclosed with an insert sheet in each envelope held in a registration position through peripheral confinement of the lines of glue which connect the envelope plies together. As an improvement over such construction U.S. Pat. No. 3,777,971 discloses a stuffed sealed envelope in which embossment means are provided in the back ply of the envelope in such a manner that each edge of the insert has an embossment means positioned adjacent to it for immobilizing the insert during processing thereof. In both these prior art constructions, the inserts are unattached to any portion of the envelope and are immobilized therein against any shifting movements relative to the envelope. In the construction according to U.S. Pat. No. 3,339,827, the holding of a loose ply in registry by the close proximity of the envelope glue lines is most difficult to carry out in practical production. Also, the use of embossment means for the construction shown in U.S. Pat. No. 3,777,971 is likewise not without its disadvantages because of the problems experienced during production thereof. Moreover, both constructions are especially limiting in that the depth of the insert cannot be easily varied and still maintained in registry unless either the location of the envelope glue lines or the location of the embossment means are accordingly changed to compensate for the various depths of different insert sheets. Effecting such changes are, however, both costly and time consuming.

OBJECTS AND SUMMARY OF THE INVENTION

It is therefore an object of the present invention to provide a stuffed sealed envelope assembly of such an improved construction over the prior art by immobilizing the insert in registration position and unattached within the envelope in such a manner as to render the insert more easily extractable from the envelope and the envelope assembly more economical and easier to manufacture.

In carrying out this objective, the insert is held in registry by means of retention chips or elements attached to the envelope plies and abutting against marginal edges of the insert sheet therein for preventing shifting movements of the insert sheet relative to the envelope. The chips comprise severed portions of the insert which can be varied in size corresponding to the size changes intended for the insert to thereby positively immobilize the inserts regardless of their limited size changes.

Other objects, advantages and novel features of the invention will become more apparent from the following detailed description of the invention when taken in conjunction with the accompanying drawings.

DESCRIPTION OF THE PREFERRED EMBODIMENT

Figure 1:
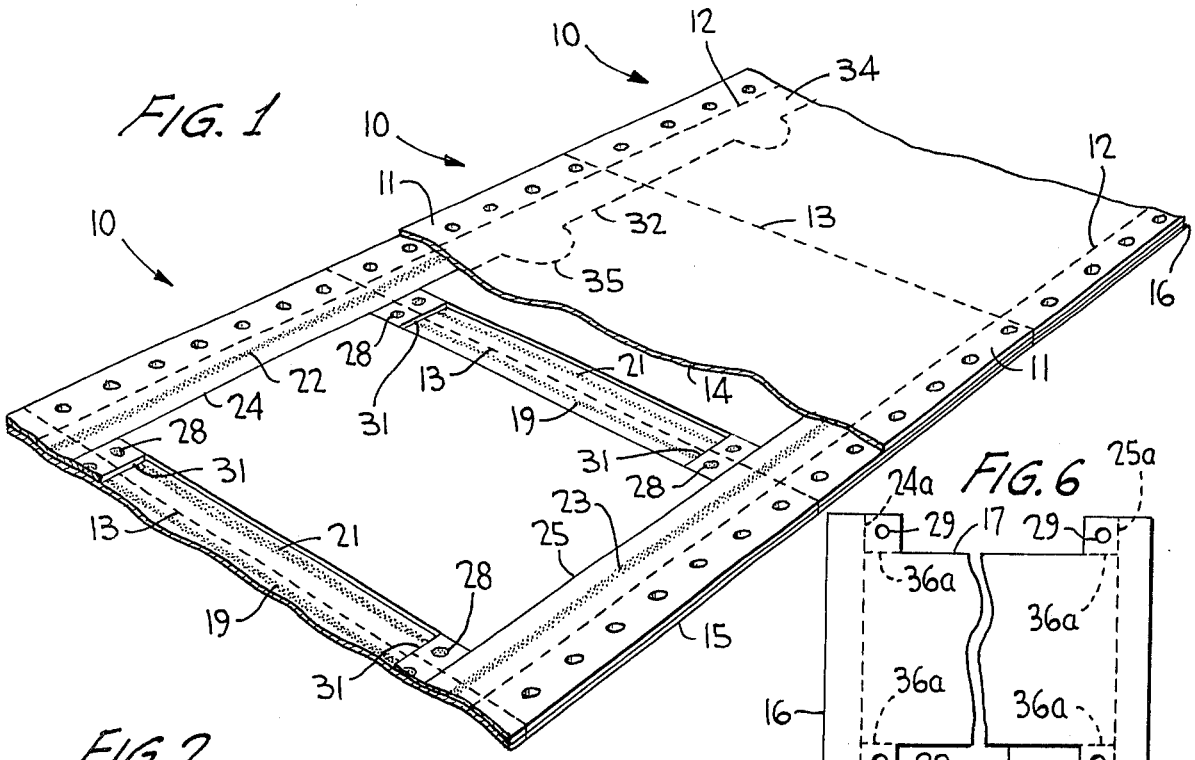
FIG. 1 is a perspective view of a series of connected envelopes in accordance with the present invention with a portion thereof broken away for clarity.
Figure 2:
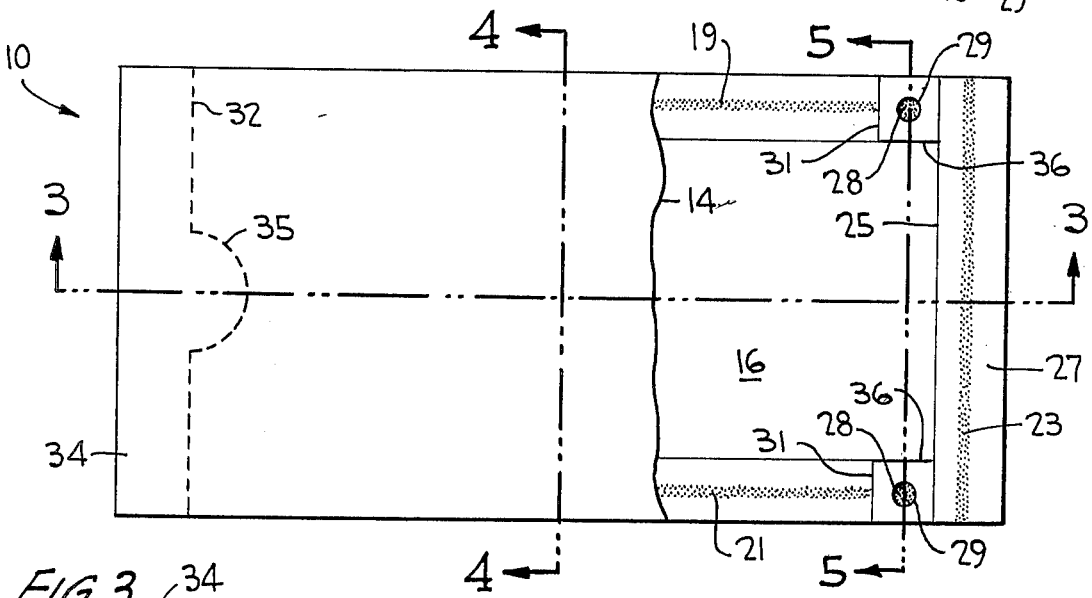
FIG. 2 is a slightly enlarged plan view of an individual envelope of the FIG. 1 assembly partly broken away for clarity.

Turning now to the drawings wherein like reference characters refer to like and corresponding parts throughout the several views, FIG. 2 shows a sealed stuffed envelope assembly 10 constructed in accordance with the present invention and after it has been burst or separated from the manifold assembly of FIG. 1. In accordance with standard practice with this art, such a manifold assembly comprises a plurality of superimposed plies of continuous webs imprinted with indicia. A record sheet or sheets (not shown) are normally disposed over or under the continuous plies forming the envelopes and are fed through the web processing equipment through the use of marginally punched feed bands 11 disposed along opposite sides of the web and removable therefrom along lines 12 of weakening. Envelope assemblies 10 are separable from one another along transverse lines 13 of weakening, such a separated envelope assembly being shown in FIG. 2 with its marginally punched feed bands 11 removed and being partially broken away to show some of the details thereof.

More specifically, the envelope assembly in accordance with the invention comprises superimposed front and back plies 14 and 15 with insert material such as an insert sheet 16 being located therebetween. It should be noted that the insert material includes at least this insert sheet although additional insert sheets and/or insert envelopes or other insert materials may generally be provided as is customary for this type of pre-stuffed, presealed envelope.

Figure 6:
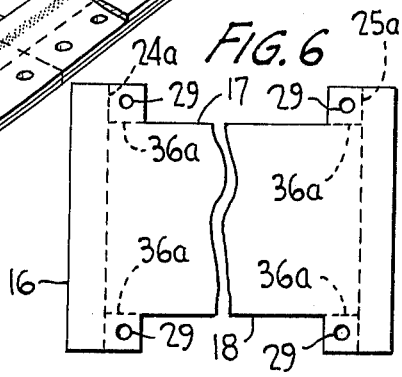
FIG. 6 is a plan view of an insert sheet before its retention chips are severed.
Figure 3:
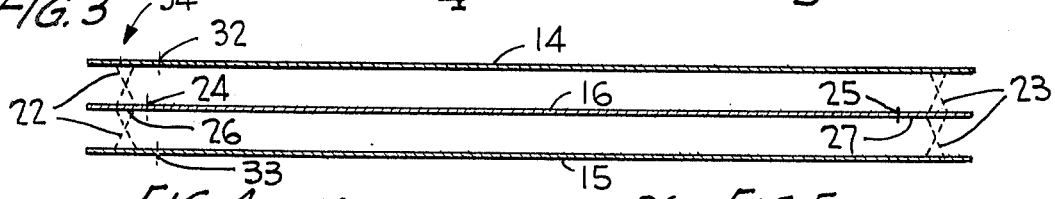
FIGS. 3, 4 and 5 are sectional view taken respectively along lines 3—3, 4—4 and 5—5 of FIG. 2.
Figure 4:
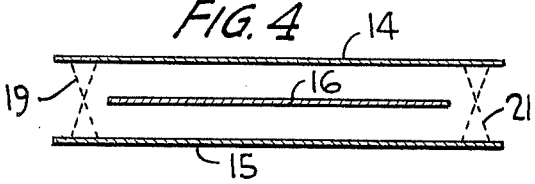
Figure 5:
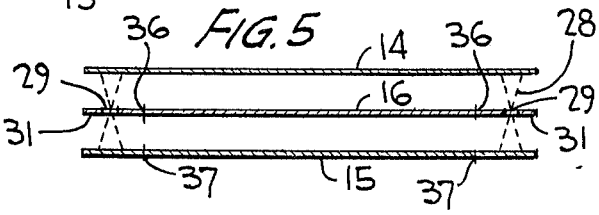

Insert sheet 16 is formed from a continuous web interconnected along transverse lines of weakening and a typical one of such insert sheets is shown in FIG. 6 having diecut areas 17 and 18 along opposite sides and being of an initial overall size equal to the respective sizes of the individual front and back plies which are secured together by streams 19 and 21 of adhesive as clearly shown in FIG. 4. Also, the outer plies of the envelope are secured together along their opposite short sides via the insert sheet by means of glue streams 22 and 23 as in the manner illustrated in FIG. 3. Some time during the collating operation while the manifold assembly is being processed, insert sheets 16 are slit along lines **24*a* and 25*a* shown in FIG. 6 so as to produce continuous cuts 24 and 25 delimiting the opposite short sides of the insert. Chip elements 26 and 27 are thereby produced which abut closely against the opposite side edges of the insert to prevent any side-to-side shifting of the insert sheets relative to the outer plies in a manner to be shown more clearly hereinafter. The insert sheet is anchored in place between the outer plies of the envelope during processing of the manifold assembly by means of spots 28 of adhesive confined within holes 29 provided in the insert sheet in the small ears or extensions 31 projecting outwardly of opposite sides of the insert sheet which are defined upon severing of the insert sheets transversely to produced cuts 24 and 25. As shown in FIG. 5, spots 28 of adhesive fill holes 29 so as to secure the insert sheet to the outer plies thereby maintaining the integrity of the manifold even after cuts 24 and 25** are made in the insert.

Lines 32 and 33 of weakening are provided in front and back plies 14 and 15 at one end of the envelope assembly as clearly shown in FIGS. 1 to 3. These lines of weakening are disposed slightly inside cut 24 of the insert sheet which delimits that short side of the insert. A tear strip 34 is therefore produced which, upon removal, will serve to open the envelope and extract the insert sheet. A thumb notch 35 may be provided at lines 32 and 33 of weakening so as to facilitate easier grasping of the tear strip which overlaps an end portion of the insert sheet.

During some convenient stage of the web processing operation, extensions 31 are severed from the remainder of the insert sheet so as to free the insert from any attachment to the envelope plies which thereby facilitates removal of the insert from the envelope. Such a severing operation may be carried out by cutting elements 31 along lines **36*a* (see FIG. 6) so as to produce clean cuts 36. These small cuts may be made through back ply 15 of the envelope as at 37 shown in FIG. 5 thereby serving the dual purpose of not only completely separating elements 31** from the remainder of the inserts but also providing slits in the envelope to permit any entrapped air therein to escape. Accordingly, a completely flat envelope assembly is made possible so as to avoid the "pillowed effect" normally occurring during the production of sealed envelopes. By venting the entrapped air within the envelopes it can be seen that the envelope assemblies may be made to lie completely flat during manifolding in the standard zig-zag fashion and any cushioning effect provided by the envelopes is substantially avoided during impact printing.

Figure 7:
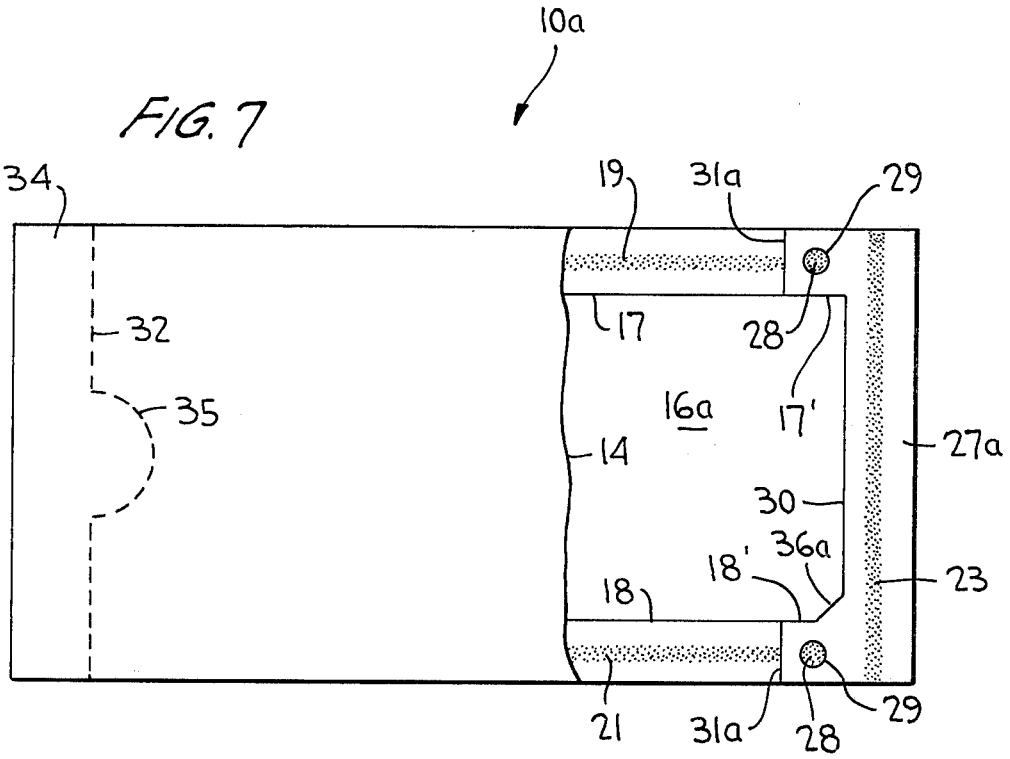
FIG. 7 is a plan view similar to FIG. 2 of an individual envelope of another embodiment partly broken away for clarity.
Figure 8:
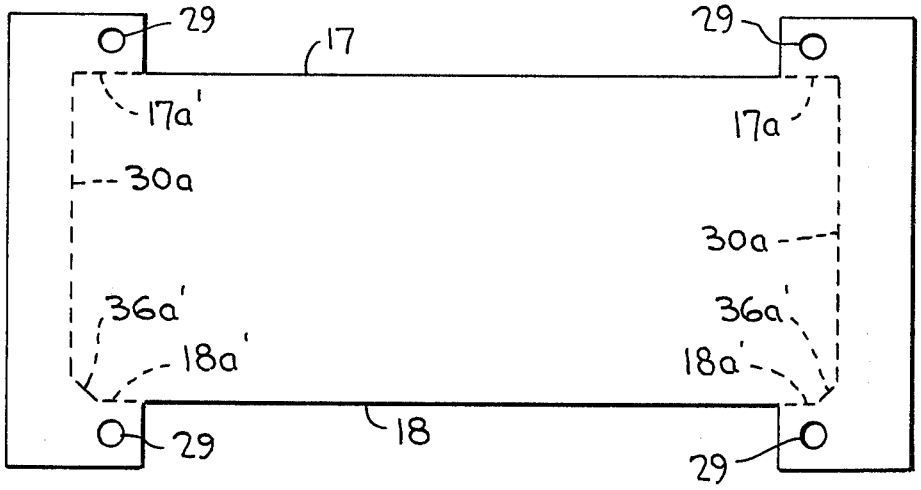
FIG. 8 is a plan view similar to FIG. 6 of an insert sheet in accordance with the FIG. 7 embodiment before its retention chips are severed.

Another embodiment of the invention is shown in FIGS. 7 and 8 wherein sealed envelope **10*a* is stuffed with insert sheet 16*a* similarly as in the FIG. 2 embodiment. Common elements between the two are therefore identified with the same reference numerals. The principal difference between the two embodiments is that the insert is immobilized within the envelope by chip elements which are substantially U-shaped in configuration. One of these elements is shown in FIG. 7 as comprising a base chip 27*a* along a short severed side edge 30, and a pair of integral short extensions 31*a* lying partially along the opposite cut side edges of the insert. A similar chip element (not shown) is provided at the opposite end of the insert. These chip or retention elements may be provided at the time diecuts 17 and 18 are made in the insert. Thus, cuts 17', 30 and 18' are made together with the diecuts respectively along lines 17'*a*, 30*a* and 18'*a* as shown in FIG. 8. However, since lines 30*a* and 18'*a* do not intersect, a small portion at 36*a'* remains at opposite lower corners of the insert thereby retaining the insert attached to the opposing chip elements. After the upper and lower envelope plies 14 and 15 are sealed together similarly as described for the FIGS. 1 to 6 embodiment, small angular cuts 36*a* are made along lines 36A' through one of the envelope plies to thereby completely free the insert from any attachment whatsoever to the envelope or to the retention elements. These cuts 36*a*** likewise serve the dual function of venting the sealed envelope from any air entrapped therein so as to avoid a "pillowing effect" during processing of the envelope assemblies.

Of course, the FIG. 7 embodiment could, without departing from the scope of the invention, be alternatively constructed as having only one small portion **36*a'*, or three or even four of such portions at a corner or corners of the insert. Hence, one, two, three or four corners of the insert would need to be cut along lines 36*a*,'** for ultimately freeing the insert from the opposing side chip elements.

From the foregoing it can be seen that a stuffed sealed envelope assembly has been provided wherein the insert material is completely unattached to any portion of the envelope plies although it is completely immobilized within the envelope by means of severed portions of the insert which have been cut away during processing of the manifold assembly so as to produce retention elements at opposite short sides of the insert as well as partially along opposite long sides of the insert. These elements act as registration means which lie closely adjacent but unattached to the insert at the marginal edges thereof so as to prevent any shifting of the insert relative to the envelope plies thereby maintaining the insert material in a desired registration position within the envelope during processing thereof through the computer printing equipment. The inserts are attached to the envelope until either elements 31 or the retention elements of FIG. 7 are finally severed away from the main body of each insert as small prepositioned slits are made in a ply of the outgoing envelope by suitable means which extend through the inserts to produce overlying cuts. Of course, these cuts may instead be in the form of punched holes if desired. Also, the depth of the inserts parallel to marginally punched feed bands 11 may be easily varied when it is desired to provide insert material of a different depth from the relative insert sheet depth shown in the drawings. For example, diecut areas 17 and 18 can be made wider in the direction parallel to the marginally punched feed bands so as to render the main body portion of the insert more narrow whereupon the depth of elements 31 and extensions **31*a* are then made correspondingly greater so that when severed at cuts 36 and 36*a*** it will serve to immobilize the insert in the running direction of movement of the manifold through the machine as described above. Various insert depths can be therefore simply and quickly accommodated without the need for changing the locations of the glue streams or any other portion of the envelope during production thereof.

Upon receipt of the outgoing envelope assembly 10 or **10*a* as shown in FIGS. 2 and 7, the recipient merely grasps tear strip 34 with one hand and the opposite end of the envelope outwardly of cut 25 or 30 with the other hand and, with a snapping movement of the hands away from one another, the insert sheet is easily and quickly extracted from the envelope after the tear-strip is removed with substantially no friction resistance offered by the inner surfaces of the envelope plies. Chip element 26,** which comprises a portion of the tear strip, is removed upon separation of the tear strip during opening of the envelopes and, by sufficiently overlapping the tear strip and thumb notches with the insert at the tear strip end, the insert may be firmly grasped for extraction.

Obviously, many other modifications and variations of the invention are made possible in the light of the above teachings. It is therefore to be understood that within the scope of the appended claims the invention may be practiced otherwise than as specifically described.

What is claimed:

1. A stuffed sealed envelope assembly comprising superimposed front and back plies, insert material having opposite side and end edges within the sealed envelope, registration means preventing shifting of said insert material relative to said front and back plies, said registration means including chip elements in abutting engagement with and unattached to each of said side and end edges of said insert material for immobilizing said insert material within the envelope, and means including a line of weakening inside one of said side and end edges in said front and back plies providing a tear strip for opening the sealed envelope and exposing said insert material for removal therefrom.

2. The envelope assembly according to claim 1, wherein said chip elements include portions of said insert material which have been severed therefrom at said end edges and along said side edges of said insert material.

3. The envelope assembly according to claim 1, wherein said chip elements include registration blocks located at said side edges of said insert material and being defined by portions of said insert material extending outwardly of said side edges, said portions being severed from said insert material by cuts extending through one of said plies.

4. The envelope assembly according to claim 3, wherein said registration blocks are secured to said plies by means of glue spots confined by holes provided in said blocks.

5. The envelope assembly according to claim 1, wherein said chip elements are substantially U-shaped in configuration so as to abut against said opposite end edges and portions of said opposite side edges.

6. The envelope assembly according to claim 5, wherein said U-shaped chip elements are defined by partially severed portions of said insert material extending outwardly of said side and said end edges, the remaining portions of said chip elements being severed from said insert material by cuts extending through one of said plies.

7. A stuffed sealed envelope assembly comprising superimposed front and back plies and insert material within the sealed envelope, registration means located within the envelope and preventing said insert material from moving relative to said plies, said insert material including at least one insert sheet having opposite side and end marginal edges, said registration means being defined by severed portions of said insert sheet lying closely adjacent and unattached to each of said marginal edges to hold said insert material in desired registration position within the envelope through peripheral confinement along at least a portion of said marginal edges, and means for opening the envelope and exposing said insert material for removal therefrom.

8. The envelope assembly according to claim 7, wherein said severed portions include registration elements at one of said opposite marginal edges, said elements being of a relatively small size compared to that of said insert sheet and being formed by cuts extending through one of said plies.

9. The envelope assembly according to claim 8, wherein said elements are secured to said plies by means of glue spots confined within holes provided in said elements.

10. The envelope assembly according to claim 1, wherein said chip elements are adhesively secured to said front and back plies.

11. The envelope assembly according to claim 7, wherein said registration means are secured to said plies.

* * * * *